US012256833B2

(12) United States Patent
Li et al.

(10) Patent No.: US 12,256,833 B2
(45) Date of Patent: Mar. 25, 2025

(54) FOLDING TABLE FRAME AND FOLDING TABLE

(71) Applicant: DEWERTOKIN TECHNOLOGY GROUP CO., LTD., Zhejiang (CN)

(72) Inventors: Long Li, Zhejiang (CN); Ying Li, Zhejiang (CN)

(73) Assignee: DEWERTOKIN TECHNOLOGY GROUP CO., LTD., Zhejiang (CN)

( * ) Notice: Subject to any disclaimer, the term of this patent is extended or adjusted under 35 U.S.C. 154(b) by 107 days.

(21) Appl. No.: 18/248,434

(22) PCT Filed: Dec. 25, 2020

(86) PCT No.: PCT/CN2020/139437
§ 371 (c)(1),
(2) Date: Apr. 10, 2023

(87) PCT Pub. No.: WO2022/099881
PCT Pub. Date: May 19, 2022

(65) Prior Publication Data

US 2023/0363526 A1 Nov. 16, 2023

(30) Foreign Application Priority Data

Nov. 10, 2020 (CN) ..... 202022581256.X

(51) Int. Cl.
*A47B 3/08* (2006.01)

(52) U.S. Cl.
CPC ..... *A47B 3/08* (2013.01); *A47B 2003/0821* (2013.01); *A47B 2003/0824* (2013.01)

(58) Field of Classification Search
CPC ..... A47B 3/08; A47B 2003/0824; A47B 2003/0821
See application file for complete search history.

(56) References Cited

U.S. PATENT DOCUMENTS

| | | | | |
|---|---|---|---|---|
| 10,349,737 | B2 | 7/2019 | Keller et al. | |
| 11,490,726 | B1 * | 11/2022 | Zhang | A47B 13/06 |
| 2018/0110324 | A1 * | 4/2018 | Keller | A47B 9/00 |
| 2018/0242728 | A1 * | 8/2018 | Hansen | A47B 3/0818 |
| 2019/0082823 | A1 * | 3/2019 | Applegate | A47B 13/003 |

(Continued)

FOREIGN PATENT DOCUMENTS

| | | |
|---|---|---|
| CN | 207940473 U | 10/2018 |
| CN | 207940474 U | 10/2018 |

(Continued)

OTHER PUBLICATIONS

ISR for PCT/CN2020/139437.

*Primary Examiner* — Daniel J Rohrhoff

(57) ABSTRACT

A folding table stand includes a crossbeam and at least two table legs. Each table leg of the at least two table legs has a folded state and an in-use state for supporting the crossbeam. The each table leg is rotatable relative to the crossbeam so that the each table leg can switch between the in-use state and the folded state. The lower end of the each table leg is connected to a foot for being supported by the ground. The crossbeam is provided with a first accommodating slot. The foot closest to the crossbeam is at least partially accommodated in the first accommodating slot when the at least two table legs are both in a folded state.

10 Claims, 3 Drawing Sheets

(56) References Cited

U.S. PATENT DOCUMENTS

| | | | | |
|---|---|---|---|---|
| 2019/0125072 | A1* | 5/2019 | Tseng | A47B 9/20 |
| 2020/0154881 | A1* | 5/2020 | Applegate | A47B 3/0815 |
| 2021/0015250 | A1* | 1/2021 | Chu | A47B 17/02 |
| 2021/0100356 | A1* | 4/2021 | Huang | A47B 17/03 |
| 2023/0270246 | A1* | 8/2023 | Lin | A47B 9/04 108/50.02 |
| 2024/0090659 | A1* | 3/2024 | Chu | A47B 9/16 |

FOREIGN PATENT DOCUMENTS

| | | | | | |
|---|---|---|---|---|---|
| CN | 110025127 | A | | 7/2019 | |
| CN | 110115422 | A | | 8/2019 | |
| CN | 210581545 | U | * | 5/2020 | |
| CN | 211722218 | U | | 10/2020 | |
| CN | 211722220 | U | * | 10/2020 | |
| WO | WO-2019174686 | A2 | * | 9/2019 | A47B 13/06 |

* cited by examiner

FOLDING TABLE FRAME AND FOLDING TABLE

CROSS-REFERENCE TO RELATED APPLICATION(S)

This is a national stage application filed under 37 U.S.C. 371 based on International Patent Application No. PCT/CN2020/139437, filed Dec. 25, 2020, which claims priority to Chinese Patent Application No. 202022581256.X filed Nov. 10, 2020, the disclosure of which is incorporated herein by reference in its entirety.

TECHNICAL FIELD

The present application relates to the field of folding tables, for example, a folding table stand and a folding table.

BACKGROUND

Tables are among the widely used articles in people's work, life, and learning. With the improvement of people's life quality, people ask for more comfortable and convenient tables.

A table includes a table top, a crossbeam, table legs, and feet. The crossbeam is disposed on the back of the table top to support the table top. Table legs are connected to the crossbeam and perpendicular to the crossbeam. However, during transport of a table, if the table legs are perpendicular to the crossbeam of the table, a large amount of space is taken up, increasing the packing volume and causing inconvenience for transport. To solve this problem, table legs are made foldable in the related art. For example, table legs are rotated by a certain angle so as to be folded, thereby saving space.

However, with regard to an existing folding table, after the table legs are rotated by a certain angle so as to be folded, the feet abut against at most the crossbeam and cannot be folded further. As a result, when in a folded state, the folding table still takes up a large space in a vertical direction.

SUMMARY

The present application provides a compact and simple folding table stand taking up a small space.

An embodiment provides a folding table stand. The folding table stand includes a crossbeam and at least two table legs. Each table leg has a folded state and an in-use state for supporting the crossbeam. Each table leg is rotatable relative to the crossbeam so that each table leg can switch between the in-use state and the folded state. The lower end of each table leg is connected to a foot for being supported by the ground.

The crossbeam is provided with a first accommodating slot, and the table leg closest to the crossbeam is at least partially accommodated in the first accommodating slot when the at least two table lees are in a folded state.

The present application also provides a folding table to reduce the space taken up by a folding table in a folded state.

An embodiment provides a folding table. The folding table includes a table top and the preceding folding table stand. The crossbeam of the folding table is connected to the lower surface of the table top.

REFERENCE LIST

Figure 1:
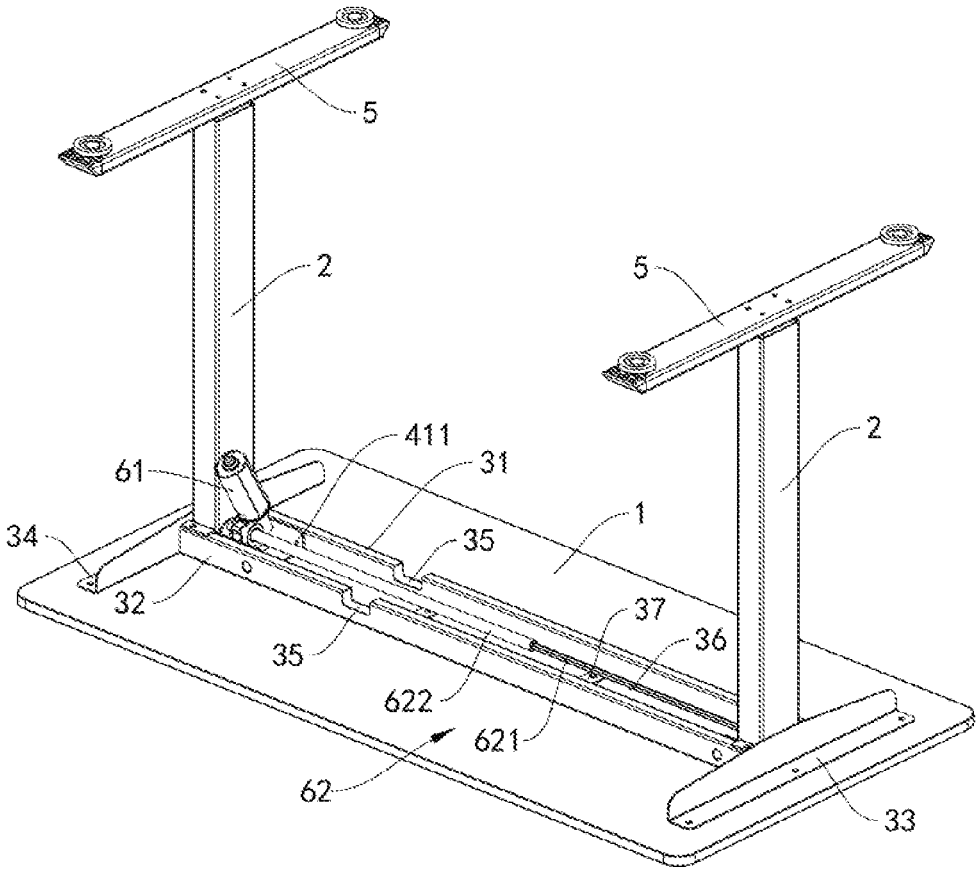
FIG. 1 is a view illustrating the unfolded state of a folding table according to embodiment one of the present application.

1 table top
2 table leg
3 crossbeam
31 first support beam
32 second support beam
33 first end beam
34 second end beam
35 first accommodating slot
36 second accommodating slot
37 reinforcing plate
38 second mounting hole
39 second through hole
4 connecting assembly
41 mounting bracket
411 first through hole
42 connecting plate
421 first mounting hole
5 foot
51 leveling member
61 drive motor
62 transmission rod group
621 inner sleeve
622 external sleeve

DETAILED DESCRIPTION

Embodiment One

As shown in FIGS. 1 to 4, this embodiment provides a folding table stand and a folding table. The folding table includes a table top 1 and the folding table stand. The folding table stand is connected to the lower surface of the table top 1 and is configured to support the table top 1.

The folding table stand of this embodiment includes a crossbeam 3 for supporting the table top 1 and two table legs 2. The crossbeam 3 is generally I-shaped. The crossbeam 3 includes a main beam and two end beams. The main beam extends along the length direction (direction L shown in FIG. 2) of the table top 1. The two end beams extend along the width direction (direction W shown in FIG. 2) of the table top 1. The two end beams are disposed at two ends of the main beam such that thee-shaped crossbeam 3 is formed.

The main beam includes a first support beam 31 and a second support beam 32 parallel to each other and spaced apart along the width direction of the table top 1. Both the first support beam 31 and the second support beam 32 extend along the length direction of the table top 1. The first support beam 31 and the second support beam 32 are each a rectangular tube to reduce the weight of the main beam. The first support beam 31 and the second support beam 32 are connected to the lower surface of the table top 1 by fasteners such as screws to simplify the connection manner and improve the assembly efficiency. In other embodiments, the first support beam 31 and the second support beam 32 may also be I-shaped steel, C-shaped steel, or solid rods. The first support beam 31 and the second support beam 32 may also be connected to the lower surface of the table top 1 by, for example, welding.

The two end beams are a first end beam 33 and a second end beam 34. The first end beam 33 and the second end beam 34 extend along the width direction of the table top 1 and are spaced apart along the length direction of the table top 1. Both the first end beam 33 and the second end beam 34 are L-shaped plates to reduce the weight of the main beam. Transverse plates of the L-shaped plates are connected to the lower surface of the table top 1 by multiple fasteners such as screws to simplify the connection manner, improve the assembly efficiency, and facilitate disassembly. Vertical plates of the L-shaped plates are connected to the main beam to improve the supporting strength of the entire crossbeam 3. In this embodiment, vertical plates of the L-shaped plates are welded to the main beam. In other embodiments, the first end beam 33 and the second end beam 34 may be I-shaped steel, C-shaped steel, or solid rods. The first end beam 33 and the second end beam 34 may also be connected to the lower surface of the table top 1 by, for example, welding.

To improve the stability of the crossbeam 3, a reinforcing plate 37 is sandwiched between the first support beam 31 and the second support beam 32. Optionally, the reinforcing plate 37 is a U-shaped plate. The baseplate of the U-shaped plate abuts against the lower surface of the table top 1. One side plate of the U-shaped plate is connected to the first support beam 31, and the other side plate of the U-shaped plate is connected to the second support beam 32. In this embodiment, the baseplate of the U-shaped plate is connected to the lower surface of the table top 1 by fasteners such as screws. Or the baseplate of the U-shaped plate may be connected to the table top 1 by welding. The two side plates of the U-shaped plate are connected to the first support beam 31 and the second support beam 32 respectively by welding, or by fasteners such as bolts and screws.

Optionally, multiple reinforcing plates 37 are provided. The reinforcing plates 37 are distributed along the extension direction of the main beam sequentially to improve the stability of the folding table stand.

For example, the table leg 2 has an in-use state and a folded state for supporting the crossbeam 3. Each table leg 2 can rotate relative to the crossbeam 3 so that each table leg 2 can switch between the in-use state and the folded state.

The folding table stand also includes a locking member corresponding to each table leg 2. The locking member locks or unlocks the relative position between the table leg 2 and the crossbeam 3. In this embodiment, when the table leg 2 is in use, the relative position between the table leg 2 and the crossbeam 3 is locked such that the table leg 2 is perpendicular to the crossbeam 3, thereby ensuring the stability of the folding table stand. When the table leg 2 needs to be folded, the table leg 2 can be folded by rotating the table leg 2 simply by removing the locking member.

In this embodiment, the upper end of each table leg 2 is rotatably connected to the crossbeam 3 by a connecting assembly 4, and the connecting assembly 4 is detachably connected to the crossbeam 3 by a locking member.

Figure 3:
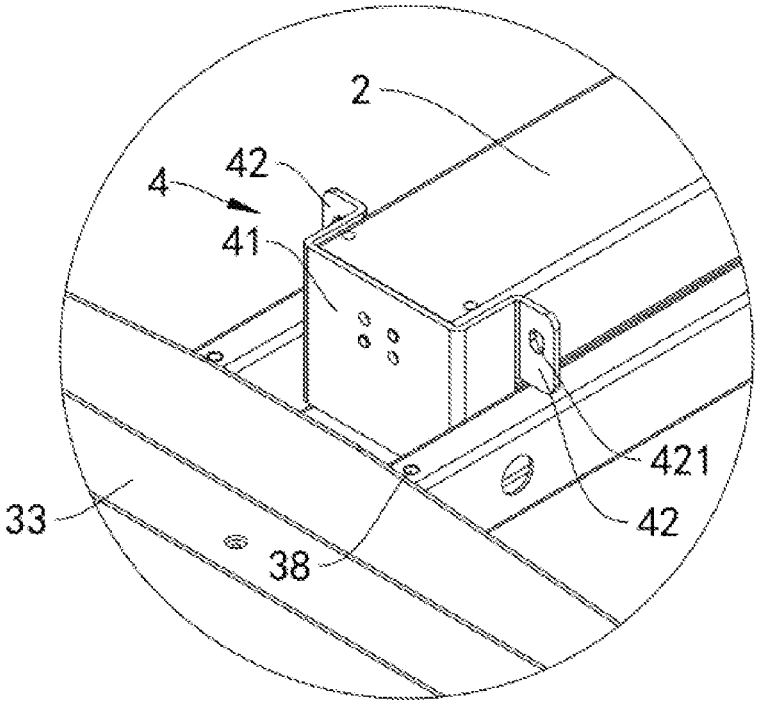
FIG. 3 is an enlarged view of part A of FIG. 2.

Optionally, as shown in FIG. 3, the connecting assembly 4 includes a mounting bracket 41 and a connecting plate 42. The mounting bracket 41 is secured to the upper end of the corresponding table leg 2, and the mounting bracket 41 is hinged to the crossbeam 3 by a hinge pin. The connecting plate 42 is connected to one end of the mounting bracket 41 facing away from the table top 1. Each connecting plate 42 is detachably connected to the crossbeam 3 by a locking member. Optionally, locking members of the folding table stand correspond to the table legs 2 in a one-to-one manner. The locking member may be a bolt, a screw, or the like. The connecting assembly 4 is connected to the upper end of the table leg 2 by fasteners such as bolts or screws. In other embodiments, the locking member may be a buckle, a hook structure, or the like. The table leg 2 may be connected to the connecting assembly 4 by welding or the like.

To fold the table leg 2, one can remove the locking member connecting the crossbeam 3 and the connecting plate 42 and rotates the table leg 2 around the hinge pin, thereby reducing the length along the direction perpendicular to the table top 1 and the space taken up by the folding table in a folded state.

In this embodiment, the connecting plate 42 and the hinge pin are provided at opposite ends of the mounting bracket 41 to prevent the connecting plate 42 from influencing the rotation of the table leg 2 when the table leg 2 is folded.

Without affecting the in-use state and the folded state of the table leg 2, the preceding connecting assembly 4 can be eliminated, that is, the upper end of the table leg 2 is directly rotatably connected to the crossbeam 3 by a hinge pin so that the table leg 2 can be in a folded state. The table leg 2 is fixed relative to the crossbeam 3 by a locking member so that the table leg 2 can stably be perpendicular to the crossbeam 3.

In other embodiments, when the table leg is in an in-use state, the table leg 2 may not be not perpendicular to the crossbeam 3 as long as the relative position between the table leg 2 in an in-use state and the crossbeam 3 is locked by the locking member.

To meet the use requirements, the table leg 2 in this embodiment has a lifting structure. For example, the table leg 2 includes two tubes sequentially sleeved from inside to outside, and the adjacent two tubes capable of moving relative to each other or being secured to each other in an axial direction. In this embodiment, the tube on the outer side is the outer tube, and the tube on the inner side is the inner tube. The upper end of the outer tube is connected to the mounting bracket 41, and the lower end of the inner tube is connected to a foot 5. In other embodiments, the lower end of the outer tube may also be connected to the foot 5, and the upper end of the inner tube may be connected to the mounting bracket 41.

The folding table stand also includes a drive motor 61. To realize synchronous lifting of the two table legs 2, the embodiment is provided with one drive motor 61 for each pair of table legs 2. The drive motor 61 is capable of synchronously lifting the two table legs 2 by a transmission unit. Compared with the case where one drive motor 61 is provided for each table leg 2, this arrangement reduces the manufacturing cost.

Optionally, two table legs 2 in a pair consist of a first table leg and a second table leg respectively. The motor mount of the drive motor 61 is connected to the connecting assembly 4 corresponding to the first table leg. The drive motor 61 has a first output shaft and a second output shaft. The two shafts are coaxial and arranged opposite. The first output shaft is connected to the first table leg by one transmission unit, and the second output shaft is connected to the second table leg by one transmission rod group 62 and one transmission unit sequentially. Both ends of the transmission rod group 62 are detachably connected to the second output shaft and the input end of the corresponding transmission unit. The transmission unit corresponding to each table leg 2 has the same structure, and the transmission unit corresponding to the second table leg will not be described here.

The drive motor 61 is mounted on the connecting assembly 4 instead of the table leg 2 as in the related art, thereby simplifying the structure of the table leg 2 and reducing the manufacturing cost of the table leg 2. After detaching the transmission rod group 62 and a locking member, as the first table leg is rotated, the drive motor 61 rotates along with the first table leg so that the drive motor 61 does not interfere with the folding of the first table leg. Then the transmission rod group 62 does not affect the rotation of the second table leg if the second table lea is rotated last.

The transmission unit includes a first bevel gear, a second bevel gear, a first lead screw, and a first nut. The first output shaft of the drive motor 61 extends into the outer tube and is connected to the first bevel gear. The first lead screw is threaded into the inner tube along the axial direction of the inner tube. The second bevel gear is connected to the upper end of the first lead screw and meshes with the first bevel gear. The first nut is sleeved on the outside of the upper end of the first lead screw and is connected to the first lead screw with a screw thread. The first nut is connected to the inner tube. To restrict the first nut from following the rotation of the first lead screw and moving relative to the first lead screw in an axial direction, this embodiment uses square tubes for both the inner tube and the outer tube.

In other embodiments, the inner tube and the outer tube may both be circular tubes. In this case, one of the inner tube outer wall or the outer tube inner wall is provided with a slide slot, and the other is provided with a slide. The slide slot and the slide cooperate in the lifting direction of the table leg 2 to prevent the first nut connected to the inner tube from following the rotation of the first lead screw.

The drive motor 61 drives the first bevel gear to rotate, the first bevel gear drives the second bevel gear which meshes with the first bevel gear to rotate, and the first lead screw rotates synchronously with the second bevel gear so that the first nut moves relative to the first lead screw in an axial direction, and then the inner tube moves relative to the outer tube in an axial direction, thereby realizing the lifting of the table leg 2.

The transmission rod group 62 is a relatively fixed or movable telescopic sleeve along an axial direction, and the length of the transmission rod group 62 can be adjusted to meet actual installation requirements. For example, a telescopic sleeve includes an outer sleeve 622 and an inner sleeve 621 threaded into the outer sleeve 622. The outer sleeve 622 is provided with at least one pair of threaded locking holes distributed at 180 degrees. A bolt is threaded through a threaded locking hole and abuts against the inner sleeve 621. In this manner, the inner sleeve 621 and the outer sleeve 622 are relatively fixed. Threaded locking holes are provided in pairs to ensure that the outer sleeve 622 and the inner sleeve 621 are coaxial.

In this embodiment, the outer sleeve 622 is provided with a telescopic hole disposed through the outer sleeve 622 along an axial direction. The cross section of the telescopic hole is a hexagon, and the inner sleeve 621 is a hexagonal prism slidably engaged with the telescopic hole to prevent the relative rotation between the inner sleeve 621 and the outer sleeve 622. In other embodiments, the cross section of the telescopic hole may also be a rectangle, a pentagon, a triangle, or the like. Accordingly, the inner sleeve 621 needs to be a tetragonal prism, a pentagonal prism, a triangular prism, or the like slidably engaged with the telescopic hole.

Optionally, multiple pairs of threaded locking holes may be provided. The pairs of threaded locking holes are distributed along the telescopic direction of the telescopic sleeve to improve the stability between the inner sleeve 621 and the outer sleeve 622 when the inner sleeve 621 and the outer sleeve 622 are relatively fixed by a bolt or the like.

The end of the outer sleeve 622 facing away from the inner sleeve 621 is detachably connected to the second output shaft, and the end of the inner sleeve 621 facing away from the outer sleeve 622 is detachably connected to the input end of the transmission unit. Optionally, the end of the inner sleeve 621 facing away from the outer sleeve 622 is plugged to the corresponding first bevel gear and rotates synchronously with the first bevel gear. The detachable connection between the outer sleeve 622 and the second output shaft is similar to the method by which the inner sleeve 621 is relatively secured to the outer sleeve 622, and the description is not repeated here.

For example, when each table leg 2 is in a folded state, neither the transmission rod group 62 or the drive motor 61 are in contact with the table top 1 so that the folding of a table leg 2 is not interfered with by the transmission rod group 62 and the drive motor 61, and the installation of the transmission rod group 62 and the drive motor 61 is facilitated.

To avoid interference caused by the mounting of a hinge pin to the lifting of the table leg 2, in this embodiment, the end of a table leg 2 facing the hinge pin and the end face of the end of the mounting bracket 41 facing the hinge pin are spaced apart. The two opposite sides of the mounting bracket 41 are provided with two opposite first through holes 411. The first through holes 411 extend along the width direction of the table top 1. The first support beam 31 and the second support beam 32 are both provided with second through holes 39, which are opposite against the first through holes 411. The hinge pin is threaded into a first through hole 411 and a second through hole 39 so that the mounting bracket 41 can drive the table leg 2 to rotate relative to the crossbeam 3 about the hinge pin, and the hinge pin does not directly contact the table leg 2, thereby ensuring that the table leg 2 can be normally lifted. In this embodiment, the hinge pin is a bolt. After the table leg 2 and the mounting bracket 41 are connected by the hinge pin, the hinge pin is locked by a locking nut, thereby preventing the hinge pin from falling off.

In this embodiment, the mounting bracket 41 is a U-shaped plate. The U-shaped slot of the U-shaped plate is disposed through the table top 1 along the length direction of the table top 1. Two connecting plates 42 are provided. The two connecting plates 42 are connected to the two opposite sides of the mounting bracket 41 in a one-to-one manner. The connecting plate 42 is disposed on the outer side of the mounting bracket 41. Each connecting plate 42 is provided with a first mounting hole 421. The first mounting hole 421 extends along the vertical direction perpendicular to the table top 1. Each first support beam 31 and each second support beam 32 are provided with a second mounting hole 38 corresponding to a first mounting hole 421. A fastener such as a bolt or a screw is threaded through a first mounting hole 421 and is connected to the corresponding second mounting hole 38 with a screw thread so that the connecting assembly 4 is connected to the crossbeam 3.

In other embodiments, without affecting the lifting of the table leg 2, the connecting plate 42 may be eliminated, and simply the mounting bracket 41 formed of a U-shaped plate may be used. The extension direction of the U-shaped slot of the U-shaped plates is the same as the length direction of the table top 1. The upper part of a table leg 2 is inserted into the U-shaped slot. Intervals are set between table legs 2 and the end faces of the mounting brackets 41 disposed at the two ends of the table top 1 in the length direction. The mounting bracket 41 is disposed at the first end the table leg 2. The mounting bracket 41 disposed at the first end of the table top 1 in the length direction is rotatably connected to the crossbeam 3 through a hinge pin. The mounting bracket 41 disposed at the second end of the table top 1 in the length direction is connected to the crossbeam 3 by fasteners such as bolts, which are parallel to the hinge pin. In this manner, the fastener connecting the mounting bracket 41 and the crossbeam 3 and the hinge pin do not contact the table leg 2, thereby avoiding influence on the lifting of the table leg 2.

Figure 2:
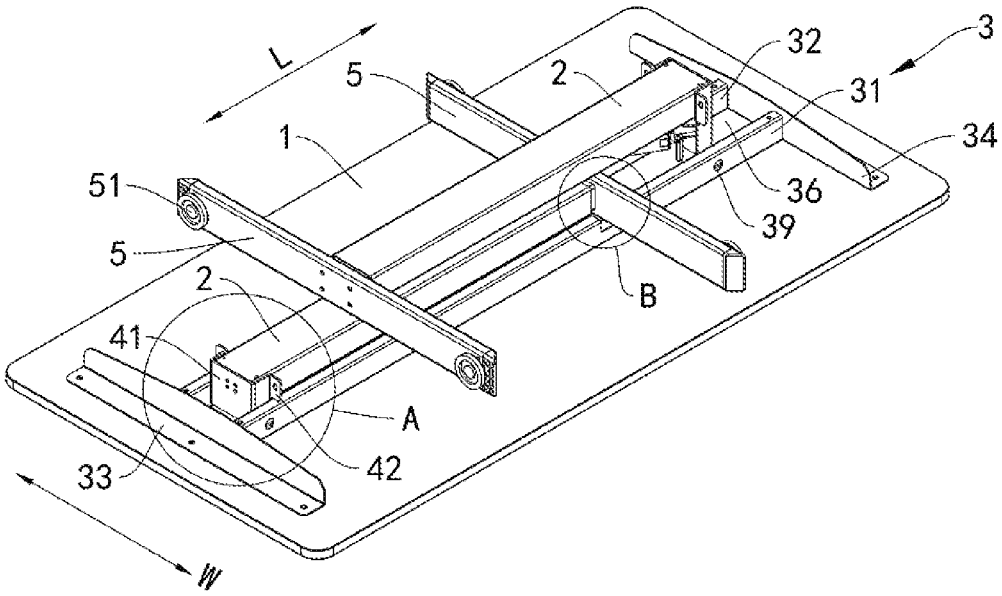
FIG. 2 is a view illustrating the folded state of the folding table without a transmission rod group according to embodiment one of the present application.
Figure 4:
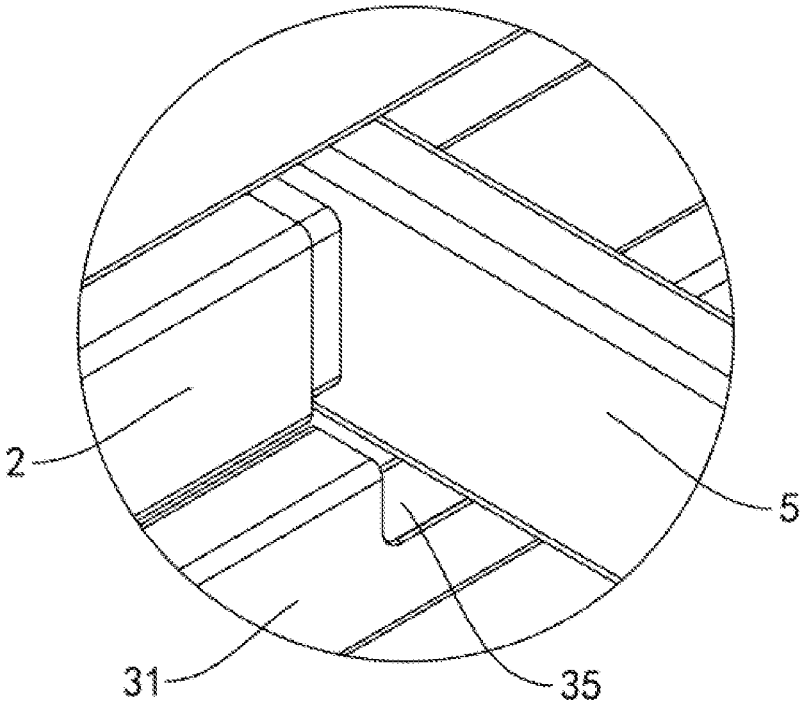
FIG. 4 is an enlarged view of part B of FIG. 2.

As shown in FIGS. 2 and 4, the crossbeam 3 is provided with a first accommodating slot 35. The lower end of each table leg 2 is connected to a foot 5 for being supported by the ground. When each table leg 2 is in a folded state, the foot 5 closest to the crossbeam 3 is at least partially accommodated in the first accommodating slot 35. Optionally, the first support beam 31 and the second support beam 32 are provided with first accommodating slots 35 opposite to each other.

By providing a first accommodating slot 35 on the crossbeam 3, when each table leg 2 is rotated into a folded state, the foot 5 closest to the crossbeam 3 is at least partially accommodated in the first accommodating slot 35, thereby solving the problem that when folding a table leg 2, because a foot 5 abuts against the crossbeam 3, the table leg 2 cannot be further folded, thereby increasing the space taken up by the folding table stand in a folded state.

The folding table stand of this embodiment reduces the length of the folding table in a folded state in the direction perpendicular to the table top 1, thereby reducing the packing volume and the space taken up, improving the transport convenience, and reducing the packing cost and the transport cost.

In this embodiment, the lower end of the table leg 2 and the corresponding foot 5 are connected by fasteners such as screws or the like. For example, each foot 5 is connected to the lower end of the corresponding table leg 2 by four screws, and the table leg 2 and its corresponding foot 5 are perpendicular to each other. In other embodiments, the table leg 2 and the corresponding foot 5 may also be non-perpendicular, and the number of screws connecting each foot 5 and the number of feet each are not limited to four.

To further reduce the space taken up by the folding table stand, in this embodiment, when each table leg 2 is in a folded state, the foot 5 at least partially accommodated in the first accommodating slot 35 is in contact with the bottom wall of the first accommodating slot 35, and the table leg 2 connected to the foot 5 cannot be further rotated.

Optionally, after the first support beam 31, the second support beam 32, the first end beam 33, and the second end beam 34 are all connected to the table top 1, a second accommodating slot 36 opened downwards is formed by being enclosed by these components and the table top. The upper end of each table leg 2 extends into the second accommodating slot 36 and is connected to the connecting assembly 4. When each table leg 2 is in a folded state, the table leg 2 closest to the crossbeam 3 is at least partially accommodated in the second accommodating slat 36. For example, the upper end of each table leg 2 is connected to the mounting bracket 41, and the mounting bracket 41 is inserted into the second accommodating slot 36. When each table leg 2 is folded, not only the foot 5 closest to the crossbeam 3 can be at least partially accommodated in the first accommodating slot 35, but also the table leg 2 closest to the crossbeam 3 can be at least partially accommodated in the second accommodating slot 36 so that the volume of the folding table stand in a folded state is still smaller, and the space taken up by the folding table stand in a folded state is further reduced.

Optionally, the depth of the first accommodating slot 35 and the second accommodating slot 36 may be defined so that when each table leg 2 is in a folded state, the table leg 2 closest to the crossbeam 3 is completely accommodated in the second accommodating slot 36, and the foot 5 connected to the table leg 2 does not protrude from the open end face of the first accommodating slot 35.

For example, the mounting brackets 41 corresponding to each pair of table legs 2 have different length in a vertical direction so that when each table leg 2 is in a folded state, the pair of table legs 2 and the crossbeam 3 are sequentially stacked. Due to the limitation of the length of a table leg 2, to avoid the large space taken up by the folding table stand in a folded state caused by the interference between two table legs 2 in a pair during folding, this embodiment limits the length of the mounting bracket 41. In this manner, each table leg 2 can be rotated least 90 degrees when changing from an in-use state to a folded state to reduce the length along the direction perpendicular to the table top 1 and the space taken up by the folding table in a folded state. In this embodiment, a table leg 2 in an in-use state is perpendicular to the crossbeam 3. When rotated 90 degrees, each table leg 2 is parallel to the crossbeam 3. By defining that two mounting brackets 41 have different lengths along the vertical direction in a folded state, one table leg 2 in a pair can be located between the other table leg 2 in the pair and the crossbeam 3, and the foot 5 connected to the table leg 2 closest to the crossbeam 3 is at least partially accommodated in the first accommodating slot 35.

In this embodiment, the distance between the connecting plate 42 connected to the mounting bracket 41 with the shorter length and the lower surface of the main beam is L1, the distance between the connecting plate 42 connected to the mounting bracket 42 with the longer length and the lower surface of the main beam is L2, and L1 is smaller than L2, to ensure that both the table legs 2 can rotate relative to the crossbeam 3, and the distance between the two table legs 2 after folding can be controlled to be smaller by the distance between L1 and L2, to reduce the length of the folding table stand in the direction perpendicular to the table top 1 after folding.

To prevent the table top 1 from interfering with the folding of the table legs 2, in this embodiment, in a folded state, an interval is provided between the mounting bracket 41 and the table top 1.

Optionally, the bottom of each foot 5 is provided with a leveling member 51 connected by a screw thread. The bottom of each foot 5 is provided with two leveling members 51 disposed at two ends of each foot 5. The leveling member 51 may be screwed to ensure the desired levelness of the table top 1 in an in-use state.

A folding table with the preceding folding table stand is folded by the steps below.

The drive motor 61 operates to make the inner tube and the outer tube move relative to each other along an axial direction so that a table leg 2 is shortened to the minimum length of the table leg 2. After removing the locking member and the transmission rod group 62, the table leg 2 connected to the shorter mounting bracket 41 is first rotated so that the foot 5 connected to the table leg 2 is at least partially accommodated in the first accommodating slot 35, and then the table leg 2 connected to the longer mounting bracket 41 is rotated to complete the folding of the folding table.

Embodiment Two

Figure 5:
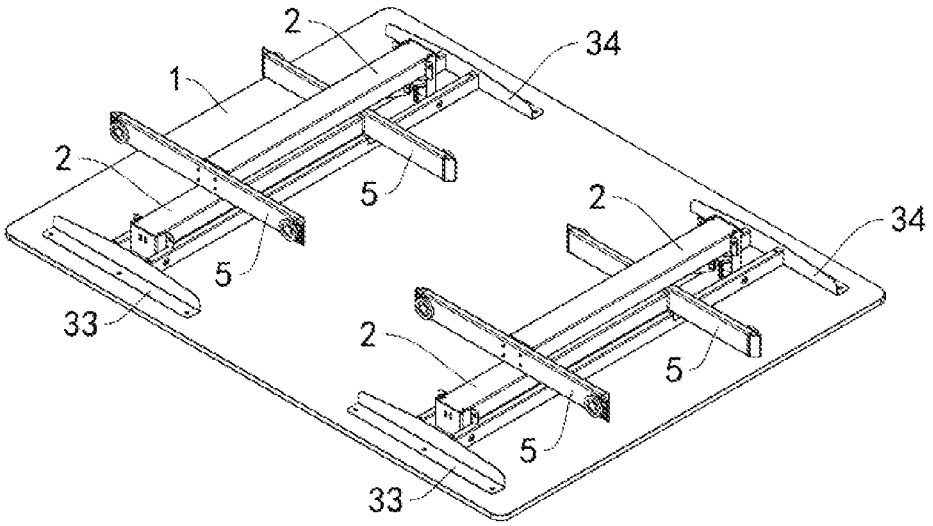
FIG. 5 is a view illustrating the folded state of a folding table according to embodiment two of the present application.

The difference between this embodiment and embodiment one is that, as shown in FIG. 5, the folding table is provided with two pairs of table legs 2, and each of the table legs is provided with one crossbeam 3. In other embodiments, the folding table stand may also be provided with three pairs of table legs 2, four pairs of table legs 2, or more. The details may be determined according to the length of the table top 1. An odd number of table legs 2 may be arranged in a peripheral direction, such as three table legs 2 arranged in a triangular.

In other embodiments, one main beam may also be provided for each pair of table legs 2, and all main beams share two end beams. It is also possible to arrange only two end beams and two main beams, and all table legs 2 are disposed in the space enclosed by the two end beams and the two main beams. The foot 5 closest to the main beam is at least partially accommodated in the corresponding first accommodating slot 35 when each table leg 2 is in a folded state.

Embodiment Three

Figure 6:
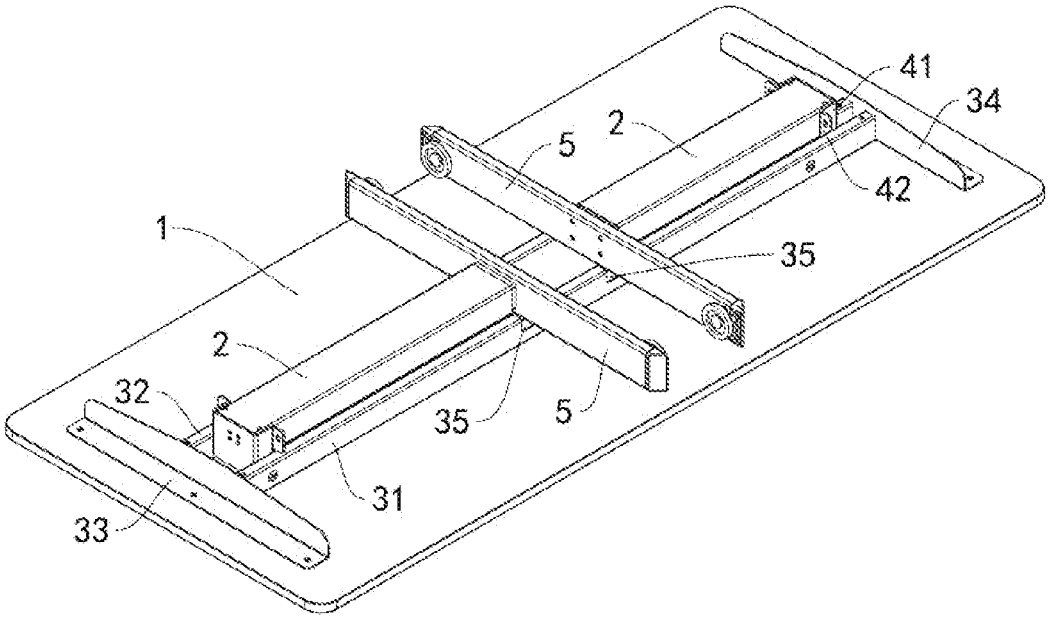
FIG. 6 is a view illustrating the folded state of a folding table without a transmission rod group according to embodiment three of the present application.

The difference between this embodiment and embodiment one is that, as shown in FIG. 6, each mounting bracket 41 is of the same length in a vertical direction, and when each table leg 2 is in a folded state, each table leg 2 is laid flat on the same side of the crossbeam 3. In this embodiment, each foot 5 is provided with a first accommodating slot 35 so that each foot 5 can be at least partially accommodated in a corresponding first accommodating slot 35. In this embodiment, a drive motor 61 can be completely accommodated in a accommodating slot 36.

With the preceding folding table stand, when each table leg 2 is in a folded state, each foot 5 is at least partially accommodated in a corresponding first accommodating slot 35. Compared with embodiment one and embodiment two, the folding table stand of this embodiment has a smaller length in the direction perpendicular to the table top 1 after folding, thereby saving more space.

Embodiment Four

In this embodiment, a table leg 2 includes three tubes sleeved from the inside to the outside sequentially, and a drive assembly for driving two adjacent tubes along an axial direction to move relative to each other, that is, the table leg 2 is a three-section telescopic tube. The upper end of the tube is connected to a mounting bracket 41, and the lower end of the innermost tube is connected to a foot 5. In other embodiments, the lower end of the outermost tube may be connected to a foot 5, and the upper end of the innermost tube may be connected to a mounting bracket 41.

The table leg 2 may be a four-section telescopic tube, a five-section telescopic tube, or a more-section telescopic tube, or the like, and may be selected according to actual requirements.

The drive assembly uses a motor lead screw structure in which multiple sleeved tubes can be retractable sequentially in the related art. Details about this structure are not described here.

The folding table stand of the present application is provided with a first accommodating slot 35 disposed on a crossbeam 2. When each table leg 2 is rotated into a folded state, the foot 5 closest to the crossbeam 3 is at least partially accommodated in the first accommodating slot 35, thereby solving the problem that when folding a table leg 2, because the corresponding foot 5 abuts against the crossbeam 3, the table leg 2 cannot be further folded, thereby increasing the space taken up by the folding table stand in a folded state.

The folding table of the present application includes a table top 1 and the preceding folding table stand connected to the lower surface of the table top 1 so that the length of the folding table in a folded state in the direction perpendicular to the table top 1 is reduced, thereby reducing the packing volume and the space taken up, improving the transport convenience, and reducing the packing cost and the transport cost.

In the description of the present application, it is to be noted that orientations or position relations indicated by terms such as "center", "upper", "lower", "left", "right", "vertical", "horizontal", "in", and "out" are orientations or position relations based on the drawings. These orientations or position relations are intended only to facilitate the description of the present application and simplify the description and not to indicate or imply that a device or element referred to must have such specific orientations or must be configured or operated in such specific orientations. Thus, these orientations or position relations are not to be construed as limiting the present application. In addition, terms such as "first" and "second" are used only for the purpose of description and are not to be construed as indicating or implying relative importance. Terms "first position" and "second position" are two different positions.

In the description of the present application, it is to be noted that unless otherwise expressly specified and limited, the term "mounted", "connected to each other" or "connected" should be construed in a broad sense as securely connected, detachably connected or integrally connected; mechanically connected or electrically connected; directly connected to each other or indirectly connected to each other via an intermediary; or intraconnected between two components. For those of ordinary skill in the art, specific meanings of the preceding terms in the present application may be construed according to specific circumstances.

What is claimed is:

1. A folding table stand, comprising a crossbeam having a support function and at least two table legs, wherein each table leg of the at least two table legs has a folded state and an in-use state for supporting the crossbeam, the each table leg is rotatable relative to the crossbeam such that the each table leg is switchable between the in-use state and the folded state, and a lower end of the each table leg is connected to a foot for being supported by a ground; and wherein the crossbeam is provided with a first accommodating slot, and when the at least two table legs are each in the folded state, a foot closest to the crossbeam is at least partially accommodated in the first accommodating slot;

the folding table stand further comprises a locking member corresponding to the each table leg, wherein the locking member is configured to lock or unlock a relative position between a corresponding table leg and the crossbeam;

wherein an upper end of the each table leg is rotatably connected to the crossbeam through a connecting assembly, and the connecting assembly is detachably connected to the crossbeam through the locking member;

wherein a lower side of the crossbeam is provided with a second accommodating slot, one end of the connecting assembly is disposed in the second accommodating slot so that when the at least two table legs are each in the folded state, a table leg closest to the crossbeam is at least partially accommodated in the second accommodating slot;

wherein the connecting assembly comprises:

a mounting bracket secured to an upper end of a corresponding table leg, wherein a first end of the mounting bracket is inserted in the second accommodating slot and is hinged to the crossbeam by a hinge pin; and a connecting plate connected to a second end of the mounting bracket, wherein the connecting plate is detachably connected to the crossbeam through the locking member.

2. The folding table stand according to claim 1, wherein the at least two table legs are arranged in pairs; and two mounting brackets corresponding to each pair among the at least two table legs in pairs have different lengths in a vertical direction so that when the at least two table legs are each in the folded state, the at least two table legs in pairs and the crossbeam are sequentially stacked; or each mounting bracket has a same length in a vertical direction so that when the at least two table legs are each in the folded state, the at least two table legs are laid flat on a same side of the crossbeam.

3. The folding table stand according to claim 2, wherein the each table leg comprises at least two tubes sequentially sleeved from inside to outside of the each table leg, two adjacent tubes of the at least two tubes are capable of moving relative to each other or being secured to each other in an axial direction of the each table leg, an upper end of one of an outermost tube or an innermost tube among the at least two tubes is connected to the connecting assembly, and a lower end of another of the outermost tube or the innermost tube is connected to the foot.

4. The folding table stand according to claim 1, wherein the each table leg comprises at least two tubes sequentially sleeved from inside to outside of the each table leg, two adjacent tubes of the at least two tubes are capable of moving relative to each other or being secured to each other in an axial direction of the each table leg, an upper end of one of an outermost tube or an innermost tube among the at least two tubes is connected to the connecting assembly, and a lower end of another of the outermost tube or the innermost tube is connected to the foot.

5. The folding table stand according to claim 4, wherein each pair among the at least two table legs in pairs is provided with a drive motor, wherein the drive motor is configured to lift two table legs in the each pair simultaneously by a transmission unit.

6. The folding table stand according to claim 5, wherein the two table legs in the each pair are a first table leg and a second table leg respectively, and a motor mount of the drive motor is connected to a connecting assembly corresponding to the first table leg; and the drive motor has a first output shaft and a second output shaft, the first output shaft and the second output shaft are coaxial and opposite to each other, the first output shaft is connected to the first table leg by one transmission unit, and the second output shaft is connected to the second table leg by one transmission rod group and one transmission unit sequentially, wherein one end of the one transmission rod group is detachably connected to the second output shaft, and another end of the one transmission rod group is detachably connected to an input end of a corresponding transmission unit.

7. The folding table stand according to claim 1, wherein a bottom of each foot is provided with a leveling member threadedly connected to the each foot.

8. A folding table, comprising a table top and the folding table stand according to claim 1, wherein the crossbeam is connected to a lower surface of the table top.

9. The folding table according to claim 8, wherein the at least two table legs are arranged in pairs; and two mounting brackets corresponding to each pair among the at least two table legs in pairs have different lengths in a vertical direction so that when the at least two table legs are each in the folded state, the at least two table legs in pairs and the crossbeam are sequentially stacked; or each mounting bracket has a same length in a vertical direction so that when the at least two table legs are each in the folded state, the at least two table legs are laid flat on a same side of the crossbeam.

10. The folding table according to claim 8, wherein the each table leg comprises at least two tubes sequentially sleeved from inside to outside of the each table leg, two adjacent tubes of the at least two tubes are capable of moving relative to each other or being secured to each other in an axial direction of the each table leg, an upper end of one of an outermost tube or an innermost tube among the at least two tubes is connected to the connecting assembly, and a lower end of another of the outermost tube or the innermost tube is connected to the foot.

* * * * *